US005787688A

United States Patent [19]

Peulve et al.

[11] Patent Number: 5,787,688

[45] Date of Patent: Aug. 4, 1998

[54] PROCESS FOR SEALING A CAST IRON CONTAINER

[75] Inventors: Jacques Peulve, Orsay; Jean-Paul Becue, Deaux, both of France

[73] Assignees: Commissariat A L'Energie Atomique; AFE Environment, both of France

[21] Appl. No.: 645,227

[22] Filed: May 13, 1996

[30] Foreign Application Priority Data

May 11, 1995 [FR] France ..... 95 05583

[51] Int. Cl.[6] ..... B65B 7/28; B65B 51/02; B67B 1/04

[52] U.S. Cl. ..... 53/478; 53/404; 53/489

[58] Field of Search ..... 53/404, 478, 329.3, 53/329.4, 423, 489; 156/69; 413/7, 21, 57, 61

[56] References Cited

U.S. PATENT DOCUMENTS

| | | | |
|---|---|---|---|
| 6,583 | 8/1849 | Beardsley | 413/7 X |
| 982,070 | 1/1911 | Johnson | 413/7 X |
| 1,105,778 | 8/1914 | Hausheer | 413/21 X |
| 1,158,044 | 10/1915 | Graham | 53/478 X |
| 2,019,841 | 11/1935 | Black et al. | 156/69 |
| 2,661,500 | 12/1953 | Seymour et al. | 156/69 X |
| 2,710,713 | 6/1955 | Slater | 53/478 X |
| 2,976,200 | 3/1961 | Stover | 156/69 X |
| 3,817,198 | 6/1974 | Leblois | 413/21 X |
| 4,089,283 | 5/1978 | Mertens et al. | 413/7 X |
| 4,508,969 | 4/1985 | Janberg et al. | 250/506.1 |
| 4,618,301 | 10/1986 | Klein | 156/69 X |
| 4,650,387 | 3/1987 | Busch | 413/61 X |
| 4,964,568 | 10/1990 | Rotolico et al. | 239/8 |
| 5,195,298 | 3/1993 | Baranowski | 53/478 X |
| 5,254,415 | 10/1993 | Williams | 429/153 |

FOREIGN PATENT DOCUMENTS

| | | | |
|---|---|---|---|
| 75-5668OW | 12/1974 | European Pat. Off. | F28F 9/16 |
| 0042882 | 6/1980 | European Pat. Off. | G21F 5/00 |
| 94-081543 | 11/1993 | European Pat. Off. | G21F 9/24 |
| 2709291 | 3/1995 | France | G21F 5/12 |
| 3405733 | 8/1985 | Germany | G21F 5/00 |
| 3405735 | 8/1985 | Germany | G21F 5/00 |
| 3503377 | 9/1986 | Germany | G21F 3/04 |
| 1250852 | 7/1969 | United Kingdom | G21F 5/015 |

*Primary Examiner*—Horace M. Culver
*Attorney, Agent, or Firm*—Hayes, Soloway, Hennessey, Grossman & Hage, P.C.

[57] ABSTRACT

A cast iron container for containing contaminated waste has a lid or cover sealed thereto by molten lead which is deposited in a channel or groove formed between the cover and the container.

9 Claims, 3 Drawing Sheets

PROCESS FOR SEALING A CAST IRON CONTAINER

FIELD OF THE INVENTION

The invention relates to a cast iron container and to its cover and which are sealed together by molten lead spraying. It also relates to the process for bringing about the sealing of said cover on the container.

The invention has applications in the field of the processing and conditioning of waste and more particularly contaminated or nuclear waste.

DESCRIPTION OF RELATED ART

When nuclear installations are dismantled, the aim is usually to reduce the volume of metal waste resulting from dismantling. For this purpose, melting takes place in an arc furnace of metal elements having a very low contamination in order to obtain cast iron.

This cast iron can be used for producing containers for containing irradiated waste. These cast iron containers consequently have the double advantage of being manufactured from recycled metal and permitting the conditioning of waste which cannot be recycled.

The manufacture of such cast iron containers is described in "Preparation and Use of Recycled Material for the Nuclear Industry"by D. BRUNING et al, Communication to the EEC, Krefeld, Germany, Oct. 1993. However, although the cast iron makes it possible to produce containers for containing contaminated waste, it is necessary to ensure that the closure of the container is as tight with respect to the contamination as the container itself. For this purpose, it is known to seal the container by means of a cast iron cover produced by a process identical to the container manufacturing process. However, no effective process is known for sealing the cover to a cast iron container.

Thus, the weldability of cast iron parts is only possible under clearly defined conditions, which are very often difficult to because of the nature of the contaminated waste in the container (e.g., nuclear biological and/or chemical waste).

For example, sealing by hot homogeneous welding has been proposed. However, such a welding procedure requires a preheating of the entire cast iron part to a temperature close to 600° C., which would give rise to differential expansions of the container and the cover. Moreover, in such a case, the stresses would be unacceptable when nuclear waste is contained in the container.

Sealing by "construction welding" is not advisable for the sealing of such cast iron parts, because the depth of the weld is limited to 6 mm. However, when sealing dangerous nuclear waste, etc., the seal between the cover and container must be at least 120 mm. Thus construction welding cannot be used for the sealing of the cast iron container in these environments.

Moreover the above-described welding processes used for the sealing of a cover on a container can not be used in the case of cast iron containers containing waste because the thermal stresses induced are unacceptable for nuclear waste containment.

SUMMARY OF THE INVENTION

The present invention is directed to overcoming the aforementioned disadvantages of conventional cast iron container and sealing methods.

To this end, the present invention provides a cast iron container on which is sealed a cover by molten lead spraying. Also, the present invention provides the process for sealing the cover on the container by the thermal spraying of a lead wire.

More specifically, the present invention provides a cast iron container for containing waste on which is placed a cover, the cover and the container having a cast iron-filled metal envelope, such that the cover and the container are separated over part of the height of the cover by a lead-filled groove obtained by machining the metal envelope and the cast iron part of the container and the cover.

Advantageously, the container has a vertically inclined inner wall the incline, towards the top of the cover forming an acute angle $\alpha$. The cover of the container has at least one inclined wall e forming with the container wall b an acute angle $\theta$ ensuring the adhesion of the lead between the walls of the cover and the container. The cover also has several planes with different inclinations ensuring a better adhesion of the lead to the wall.

The invention also relates to the process for sealing the cast iron container by a cast iron cover. The method comprises the steps of:

depositing a cover on the container, both having been previously machined so as to form a groove between them.

Cleaning the groove with respect to harmful elements and dust present.

Depositing by thermal spraying molten lead in the groove over the entire contour of the cover.

Advantageously, in a preferred embodiment of the present invention, the lead is in wire form.

According to the process of the invention the container, prior to depositing a cover on the container, the cast iron container is placed on a rotary table, driven by a motor in order to ensure even deposition of the lead wire.

In addition, the harmful element and dust cleaning takes place by the projection of a compressed air jet into the groove, followed by the suction of said harmful elements and dust.

DETAILED DESCRIPTION OF PREFERRED EMBODIMENTS

Figure 1:
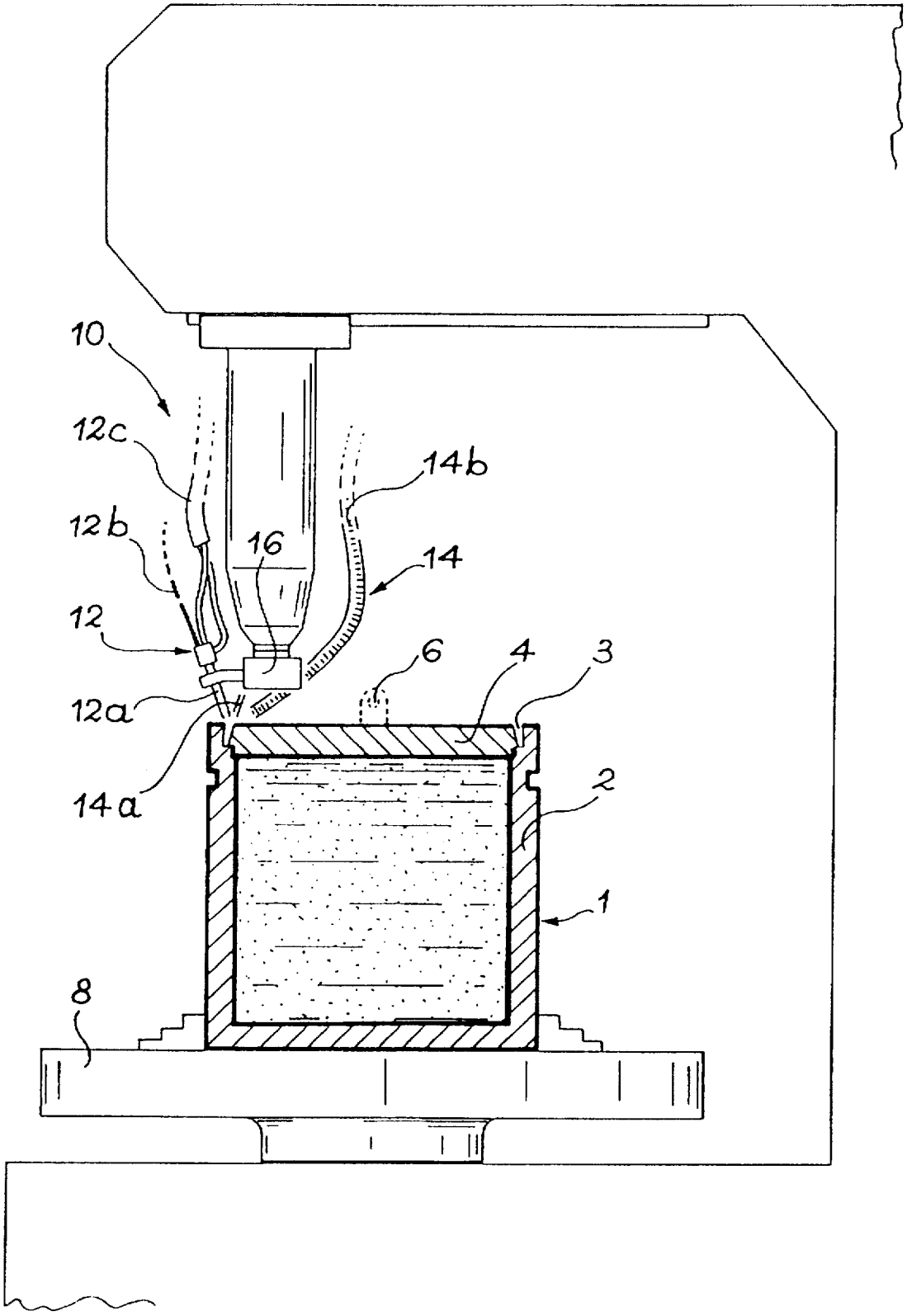
FIG. 1 shows the cover, container and deposition apparatus of the present invention to seal the cover by thermal spraying of molten lead.

FIG. 1 shows the apparatus of the present invention permitting the sealing of the cover 4 to the container 2. FIG. 1 shows the complete waste container with its cover 1. The assembly 1 has the actual container 2 and the cover 4, both made from cast iron. The cover 4 is placed on the container 2 and incorporates a gripping hook 6 enabling it to be raised for placing on the container 2. According to the invention, the hook 6 is detachable and can be removed when the cover is in place.

The container/cover assembly 1 is then deposited on a rotary plate 8, which is driven by a motor (not shown in the drawing for simplification reasons), so as to perform a regular rotary movement. This rotary plate can be a positioner, such as is used in the welding field. Thus, driven by the rotary table 8, the container 2 and its cover 4 are subject to a rotary movement with respect to the means 10 for sealing the cover on the container. These sealing means 10 consist of a spray gun 12 and a system for cleaning the dust and harmful elements 14.

More specifically and as will be described in greater detail hereinafter, the container 2 is separated from the cover 4 by a groove 3 in which the lead wire in such a way as to bring about a lead sealing of the cover 4 on the container 2.

In order to ensure a good adhesion of the lead on the walls of said groove 3, use is made of a cleaning system 14 for removing all dust and harmful elements which may be present in said groove 3. Thus, the cleaning system 14 incorporates an air supply tube **14*a*, which projects compressed air into the groove 3 in order to remove any dust and foreign bodies located there. Moreover, to improve the elimination of such dust and harmful elements, a fume hood 14*b*** sucks up the dust and foreign bodies which have flown off under the effect of the pressure of the compressed air jet.

When the groove 3 is cleaned, the lead wire can then be deposited there by means of the spray gun 12. The gun 12 has a lead spraying nozzle **12*a*, a lead wire supply 12*b* and fluid supply tubes 12*c*. According to an embodiment of the invention, the lead wire 12*b*** has a diameter of approximately 3 mm. For example, the device projecting lead wire at a rate of 7.5 m/min would make it possible to spray in one hour approximately 36 kg of lead.

Advantageously, the lead spray gun is oriented by an angle of approximately 9° with respect to the vertical, so that the lead jet covers the complete bottom of the groove 3. Preferably, the spray gun is oriented by means of a robotized arm 16.

Such a lead spray gun is known and used in the nuclear sector, e.g., for the coating of glove boxes or for the coating of accelerator chambers, as well as for covering elements which emit high radiation. For example, this gun is used for eliminating a source of irradiation which is too high to permit the clogging of the source by human action. Thus, as it is known, the spray gun for performing the lead thermal spraying process will not be described in greater detail. However, it is pointed out that this lead thermal spraying procedure involves reasonable costs, both with regards to capital expenditure and use.

Figure 2:
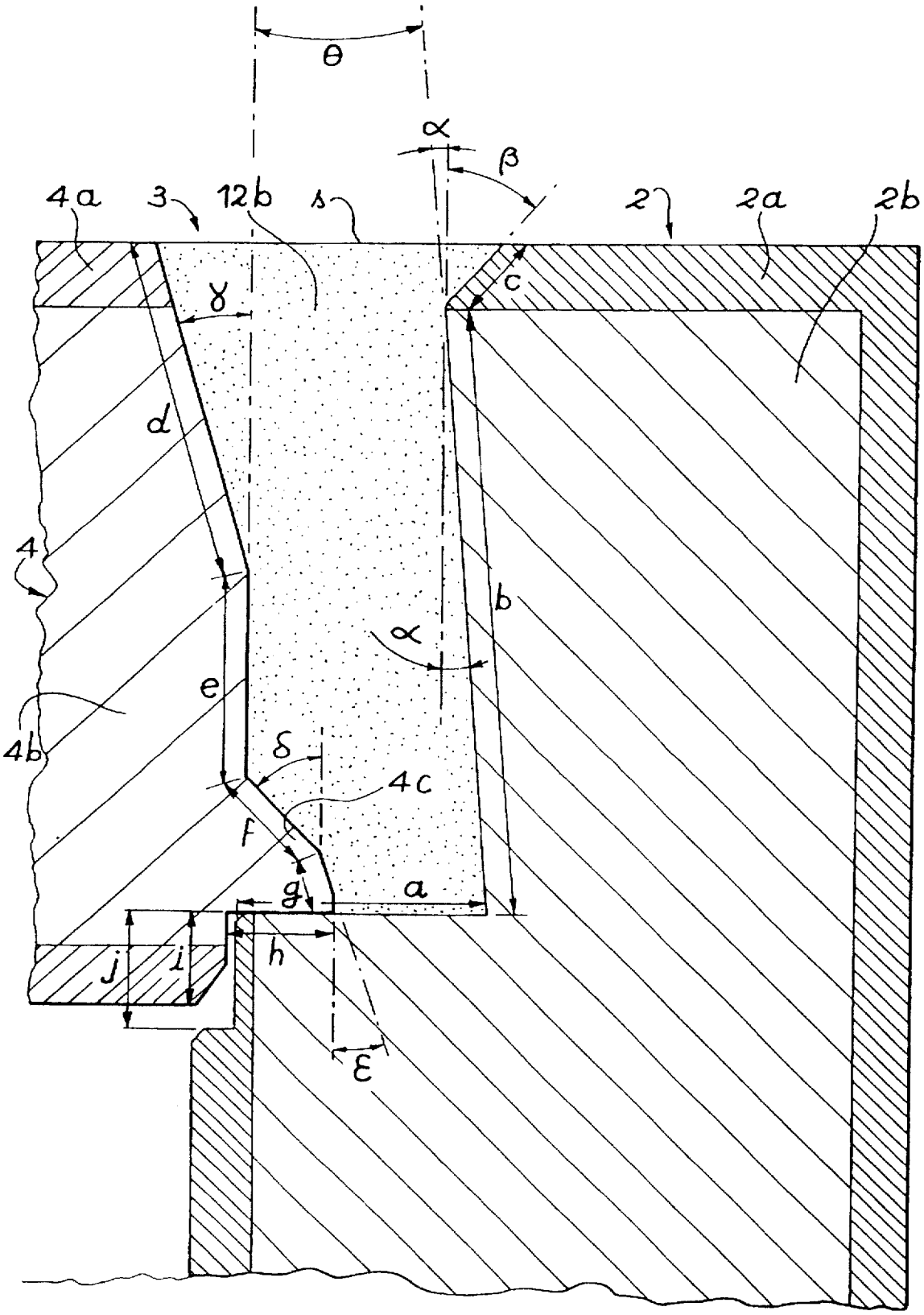
FIG. 2 is a close-up view of the present invention depicting the area adjacent to the lead-filled groove located between the cover and the container.

FIG. 2 shows in detail the groove 3 located between the cover 4 and the container 2. Typically, the container 2 is produced by means of an envelope **2*a*, which can e.g., be of steel and which is filled with cast iron obtained from recycled, metallic materials. The cast iron part of the container 2 is designated 2*b*. In a similar way, the cover 4 is produced by means of an steel envelope 4*a* filled with cast iron 4*b***.

As can be seen in FIG. 2, the groove 3 was obtained between the cover 4 and the container 2 as a result of a machining of the cover and the container. It is filled with lead **12*b* represented by mottling in FIG. 3. The container 2 has been machined so as to have a relatively deep channel on the bottom (a) of which is at least partly placed the cover 4. More specifically, the cast iron part of the container 2 has been machined so as to have a horizontal surface (a), which constitutes the bottom of the groove 3. The inner wall of the container, designated b, has been machined so as to form an angle of approximately 2° to 5° with respect to the vertical and closed towards the opening of the groove 3 (i.e. the surface of the groove). The angle formed by the wall b relative to the vertical is designated $\alpha$. The inclination of the wall b made from cast iron makes it possible, when the groove 3 is filled with lead, to ensure that the flowing lead cannot flow out from the groove. In addition, the steel envelope 2*a* of the container 2 is surface-machined, on the border of the groove 3, so as to form an angle of approximately 45° with respect to the vertical. This angle is designated $\beta$ and the edge of the envelope 2*a* bordering the groove 3** is designated c.

In order to permit an even better adhesion of the lead in the groove 3 and in particular on the walls of the cover 4, the wall has also been machined so as to have several inclined planes with different inclinations. The side d produced in the envelope **4*a* and in part in the molten metal, e.g. molten lead, 4*b* of the cover 4 forms, with respect to the vertical, an angle $\gamma$ of approximately 15° open towards the surface of the groove 3**.

The side e of the cover is machined so as to be substantially vertical in order to give an angle between 2° and 5° with the side b. This angle, between the side e and the side b, is an acute angle $\theta$. It ensures a retention of the lead bead between the container 2 and its cover 4 by producing a "jamming" effect in the case of a pulling off of the cover, in other words when the cover 4 was subject to a tensile stress. The obtained lead sealing bead has a substantially frustum-shaped cross-section.

The side f of the cover 4 is machined in inclined manner and forms, with respect to the vertical, an angle $\delta$ of approximately 45°, closed towards the bottom (a) of the groove 3. The side g adjacent to the side f and issuing onto the bottom (a) of the groove 3 is machined so as to be inclined overall by an angle $\epsilon$, with respect to the vertical. This angle $\epsilon$, closed towards the bottom (a) of the groove 3, is approximately 15°.

It is clear that the machining of the side wall of the cover 4 and the machining of the inner wall of the container, as shown in FIG. 2, only constitute examples. The length of the sides and the values of the different angles can obviously differ from the values given hereinbefore and all such variations are deemed covered by the present invention.

In the preferred embodiment, it is pointed out that the height of the groove 3 from its surface s to its bottom a is max 116 mm.

At its lower base, the cover 4 has a machining leading to a right angle between the side h and the side i of the cover 4. This machining enables the cover to be introduced along the inner wall of the container 2, whilst bearing by its side g on the bottom (a) of the groove 3.

The container 2 can also have a supplementary machining on its inner wall, producing the side j and enabling the side i of the cover 4 to be fitted along the side j of the container 2.

Thus, the cover 4 can be very easily introduced into the container 2. The side h of the projection **4*c* of the cover bears on the bottom (a) of the groove 3**. The side i of the cover forming a right angle with the side g ensures the centring of the cover along the side j of the inner wall of the container.

The different planes of the walls of the cover 4 and the container 2 ensure a good adhesion of the lead and permit an easier introduction of the spray gun and the cleaning system.

Advantageously, the side wall of the cover and the inner wall of the container are rough, so as to permit a better adhesion of the lead.

Figure 3:
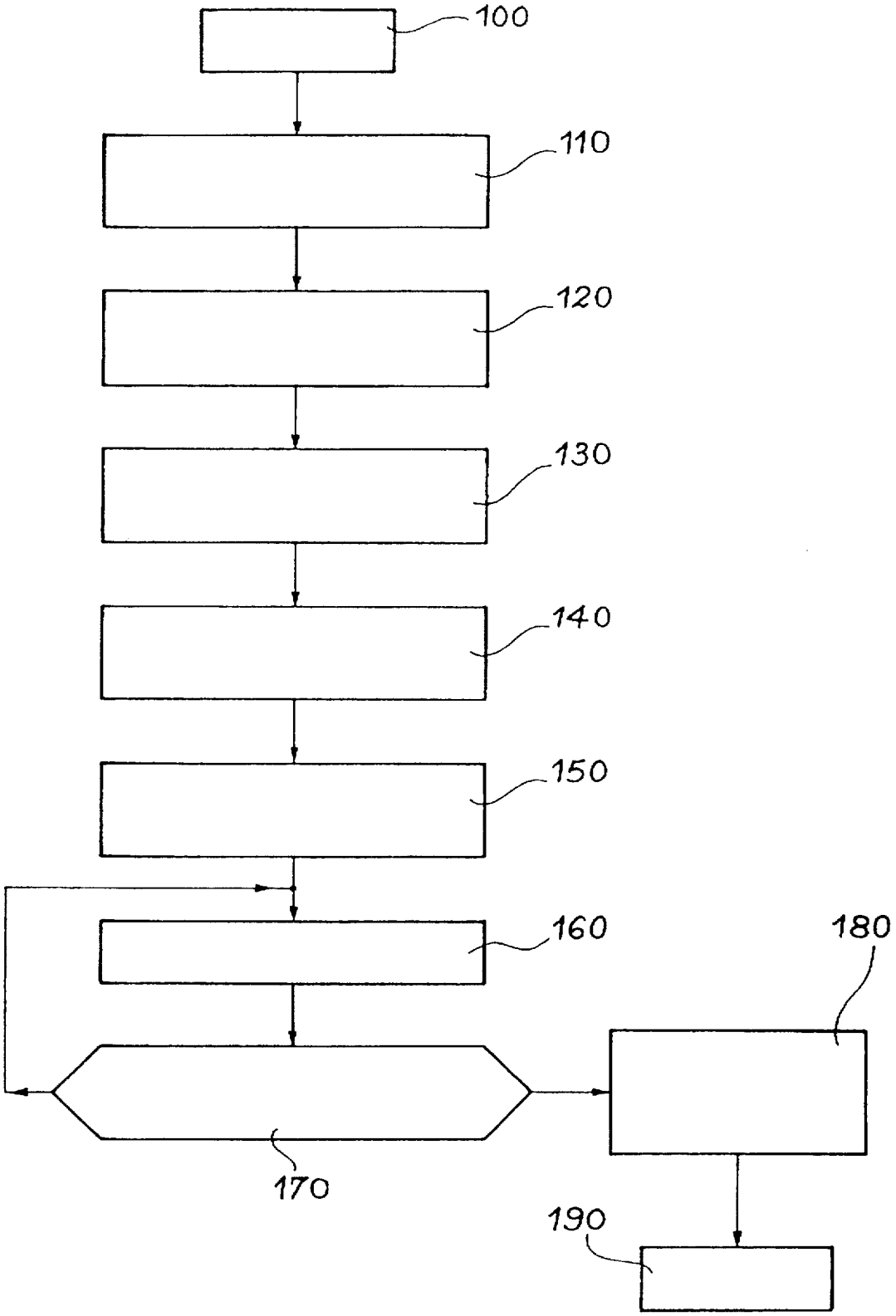
FIG. 3 a functional block diagram of the sealing process for the cast iron container of the present invention.

FIG. 3 shows the functional diagram of the different stages of the process permitting the sealing of the cover to the container.

On this functional diagram, block 110 represents the placing of the cover 4 on the container 2, which takes place by means of the gripping hook 6 shown in FIG. 1. The cover is centred in the container opening. Preferably, the recision of centring of the groove is below 1 mm. When the container is provided with its cover, the container-cover assembly is placed on the rotary table during a stage 120.

Block 130 represents the stage of putting into place the sealing means, i.e. the spray gun, as well as the fume hood, the spraying tube for the compressed air jet, etc. All the components constituting sealing means are placed in the most appropriate position for sealing the cover on the container.

Block 140 represents the stage of rotating the rotary table on which has been deposited the container and its cover.

Block 150 represents the operation of cleaning dust and harmful elements which may have been left in the groove 3. More specifically, said cleaning consists of blowing into the groove a compressed air jet in order to remove all cast iron dust, abrasive elements and foreign bodies, which could prejudice the good adhesion of the lead to the groove walls. More specifically, the air nozzle used for said compressed air projection operation is placed in the groove at a height of approximately 70 mm with respect to the bottom of the groove.

When the dust and harmful elements have been cleaned away, the position of the spray gun is refined and the wire and fluid supply for the gun is checked. More specifically, the fluids supplying the gun 12 are oxygen, acetylene and compressed air. For example, the oxygen can have a flow rate of 1500 l/h, the acetylene a flow rate of 750 l/h and the compressed air a flow rate of 30 $m^3$/h. This setting improvement takes place in the stage represented by the block 160. Block 160 represents the lead spraying stage, which involves a substage of positioning the gun in the groove at a height of approximately 75 mm with respect to the bottom of the groove and with an angle of approximately 9° with respect to the vertical, so that the lead jet supplied by the gun covers the entire bottom of the groove.

Thus, the gun setting must be refined in such a way that the lead jet is centred so that a minimum of lead is deposited on the walls of the groove. During deposition, there is a virtually permanent check on the firing distance to ensure that it is between 70 and 100 mm. This is brought about by periodically raising the gun. A check must also take place during operation to establish that the entire operation is taking place continuously, because any untimely stoppage could prejudice a good sealing of the cover on the container. In addition, the stoppages necessary for monitoring and for changing lead wire reels are as short as possible. Moreover, a mechanical densification of the lead takes place by milling during the process.

Block 170 represents a test stage during which a check is made to establish whether the filling of the groove is completed and correctly performed. If this is not the case, stage 160 is repeated until the groove is entirely and correctly filled. If this is not the case lead spraying is stopped, as is the rotation of the rotary table, as is represented by block 180.

This constitutes the end of the sealing operation for the container 2 and it is then possible to seal a second container.

As explained in FIG. 2, the adhesion of the lead to the walls of the groove can be further improved if said walls are rough. Thus, in order to make the different sides of the cover 4 and the container 2 even more adhesive, it is possible to blast these walls with an abrasive jet in order to make them rough. The abrasive dust left within the groove after the blasting of the walls is cleaned either by blowing with a compressed air jet or by suction. According to the preferred embodiment described relative to FIG. 1, the cleaning of the groove 3 takes place both by blowing a compressed air jet and by the suction of the dust propelled by the air jet. This stage is not shown in the diagram of FIG. 3, because it can be performed either between stages 120 and 130, or at the time of machining the container and its cover.

When sealing is done, it is possible to monitor the quality of the lead seal joint by infrared thermal imaging measurements. This quality control consists of checking for the absence of internal cracks or any detachment at the joint/cover interface or the joint/container interface. More specifically, the control procedure consists of transmitting a thermal flux to a so-called "hot" source, which is the cover or container (as a function of the particular case) and observing the propagation of said heat up to the cold source, namely the container or cover, respectively, via the lead joint.

If the joint adheres perfectly to the interface on the cover side and container side, then the heat is propagated homogeneously from the hot source to the cold source and the thermal image obtained by the infrared camera is then perfectly uniform.

In the opposite case, i.e. if the joint has an adhesion deficiency with respect to one of the joint/cover or joint/container interfaces, the infrared image is characterized by a dark mark in the centre of a bright surface. The above mentioned process is repeated until a correct seal is obtained.

We claim:

1. A process for sealing a cast iron cover to a cast iron walled container wherein the cover is supported on the container with its outer edge resting on a lip formed on the inside of the container wall, a portion of the inside of the container wall and the outer edge of the cover being angled to define a groove therebetween; placing said cover on said container, cleaning any dust and other contaminants present in the groove, and depositing molten lead in the groove.

2. A process according to claim 1, wherein said molten lead is deposited in said groove using a thermal spraying apparatus.

3. A process according to claim 2, wherein said molten lead is fed to said thermal spraying apparatus in the form of a lead wire.

4. A process according to claim 1, and including the step of placing said container on a rotary table and rotating said table while depositing said molten lead.

5. A process according to claim 1, wherein the dust and other contaminants are cleaned from said groove by directing a compressed air jet into the groove.

6. A process according to claim 1, wherein and including the step of machining said outer edge of said cover and the inside wall of said container to form the wall defining said groove.

7. A process according to claim 1, wherein walls defining said groove are angled so that said molten lead, when hardened, cannot be removed from said groove.

8. A process according to claim 1, wherein the surfaces of the walls defining the groove are rough, so as to permit better adhesion of the lead.

9. A process according to claim 1, wherein the groove is formed by tooling the cover and the container so as to incline at least a portion of the container inside wall, with respect to the vertical, towards the top of the cover, whereby to form an acute angle ($\alpha$), and to incline at least a portion of the cover outer wall edge, whereby to form an acute angle ($\theta$), which ensures the adhesion of the lead between the walls of the cover and the container.

* * * * *